US006754977B2

(12) United States Patent
Roberts

(10) Patent No.: US 6,754,977 B2
(45) Date of Patent: Jun. 29, 2004

(54) METHOD AND APPARATUS FOR DRYING LONG FIBRE HAY

(75) Inventor: Robert John Allan Roberts, Falher (CA)

(73) Assignee: Peace River Timothy Inc., Nampa (CA)

( * ) Notice: Subject to any disclaimer, the term of this patent is extended or adjusted under 35 U.S.C. 154(b) by 0 days.

(21) Appl. No.: 10/241,821

(22) Filed: Sep. 10, 2002

(65) Prior Publication Data

US 2003/0061729 A1 Apr. 3, 2003

(30) Foreign Application Priority Data

Sep. 10, 2001 (CA) ..... 2356824

(51) Int. Cl.[7] ..... F26B 5/08

(52) U.S. Cl. ..... 34/318; 34/328; 34/386; 34/395; 34/429; 34/591; 34/63; 34/108

(58) Field of Search ..... 34/318, 321, 326–328, 34/386, 391, 393–395, 429, 591, 62, 63, 66, 79, 108; 414/24.5, 24.6, 25; 56/341; 53/23, 24.29, 28, 68

(56) References Cited

U.S. PATENT DOCUMENTS 3,840,189 A * 10/1974 Kanengieter et al. ..... 241/48
4,561,194 A 12/1985 Sutch
4,640,021 A * 2/1987 Gullickson ..... 34/507
4,644,666 A * 2/1987 Eberle et al. ..... 34/515
4,827,628 A * 5/1989 Bert ..... 34/65
5,105,563 A * 4/1992 Fingerson et al. ..... 34/203
5,157,849 A 10/1992 Ronning ..... 34/135
D335,675 S 5/1993 Herron ..... D15/27
5,347,729 A 9/1994 Meyer
5,557,859 A * 9/1996 Baron ..... 34/378
5,692,317 A 12/1997 Manzolli ..... 34/386
6,079,119 A 6/2000 Magnusson

* cited by examiner

*Primary Examiner*—Ira S. Lazarus
*Assistant Examiner*—Andrea M. Ragonese
(74) *Attorney, Agent, or Firm*—Christensen O'Connor Johnson Kindness PLLC

(57) ABSTRACT

A method and apparatus for drying long fiber hay. A first step involves providing round bales of long fiber hay. A second step involves separating the bales to form a loose mass of long fiber hay. A third step involves feeding the loose mass of long fiber hay into a rotary dehydration drum. A fourth step involves separating the loose mass of long fiber hay from air containing entrained moisture by passing the long fiber hay through a cyclone separator with a first stream of air passing to an exhaust and a second stream of the loose mass of long fiber hay passing into an air lock. A fifth step involves cooling the loose mass of long fiber hay. A sixth step involves passing the loose mass of long fiber hay through a hay baler, whereby the loose mass of long fiber hay is formed back into bales.

6 Claims, 2 Drawing Sheets

METHOD AND APPARATUS FOR DRYING LONG FIBRE HAY

FIELD OF THE INVENTION

The present invention relates to a method and apparatus for drying long fibre hay in preparation for foreign shipment.

BACKGROUND OF THE INVENTION

The practise has developed in North American to form long fibre hay into bales. Foreign feed importing countries, such as Japan, are prepared to pay a premium price for long fibre hay. However, there is presently no effective way of drying the bales sufficiently to prevent substantial spoilage during transport.

SUMMARY OF THE INVENTION

What is required is a more effective manner of drying long fibre hay for shipment to foreign feed importing countries.

According to a first aspect of the present invention there is provided a method for drying long fibre hay. A first step involves providing round bales of long fibre hay. A second step involves separating the bales to form a loose mass of long fibre hay. A third step involves feeding the loose mass of long fibre hay into a rotary dehydration drum. A fourth step involves separating the loose mass of long fibre hay from air containing entrained moisture by passing the long fibre hay through a cyclone separator with a first stream of air passing to an exhaust and a second stream of the loose mass of long fibre hay passing into an air lock. A fifth step involves cooling the loose mass of long fibre hay. A sixth step involves passing the loose mass of long fibre hay through a hay baler, whereby the loose mass of long fibre hay is formed back into bales.

According to another aspect of the present invention there is provided an apparatus for drying long fibre hay which includes a hay bale separator adapted to separate a round bale into a loose mass of long fibre hay. A rotary dehydration drum is provided. A conveyor conveys the loose mass long fibre hay from the separator to the rotary dehydration drum. There is also provided a cyclone separator, an exhaust and an air lock. The cyclone separator is adapted to remove air containing entrained moisture from the loose mass of long fibre hay. Ducting is provided for conveying the loose mass of long fibre hay containing air from the rotary dehydration drum to the cyclone separator, delivering a first stream of only air to the exhaust and delivering a second stream of only the loose mass of long fibre hay to the air lock. Means is provided for cooling the loose mass of long fibre hay. A baler is provided which is adapted to form the loose mass of long fibre hay back into bales.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
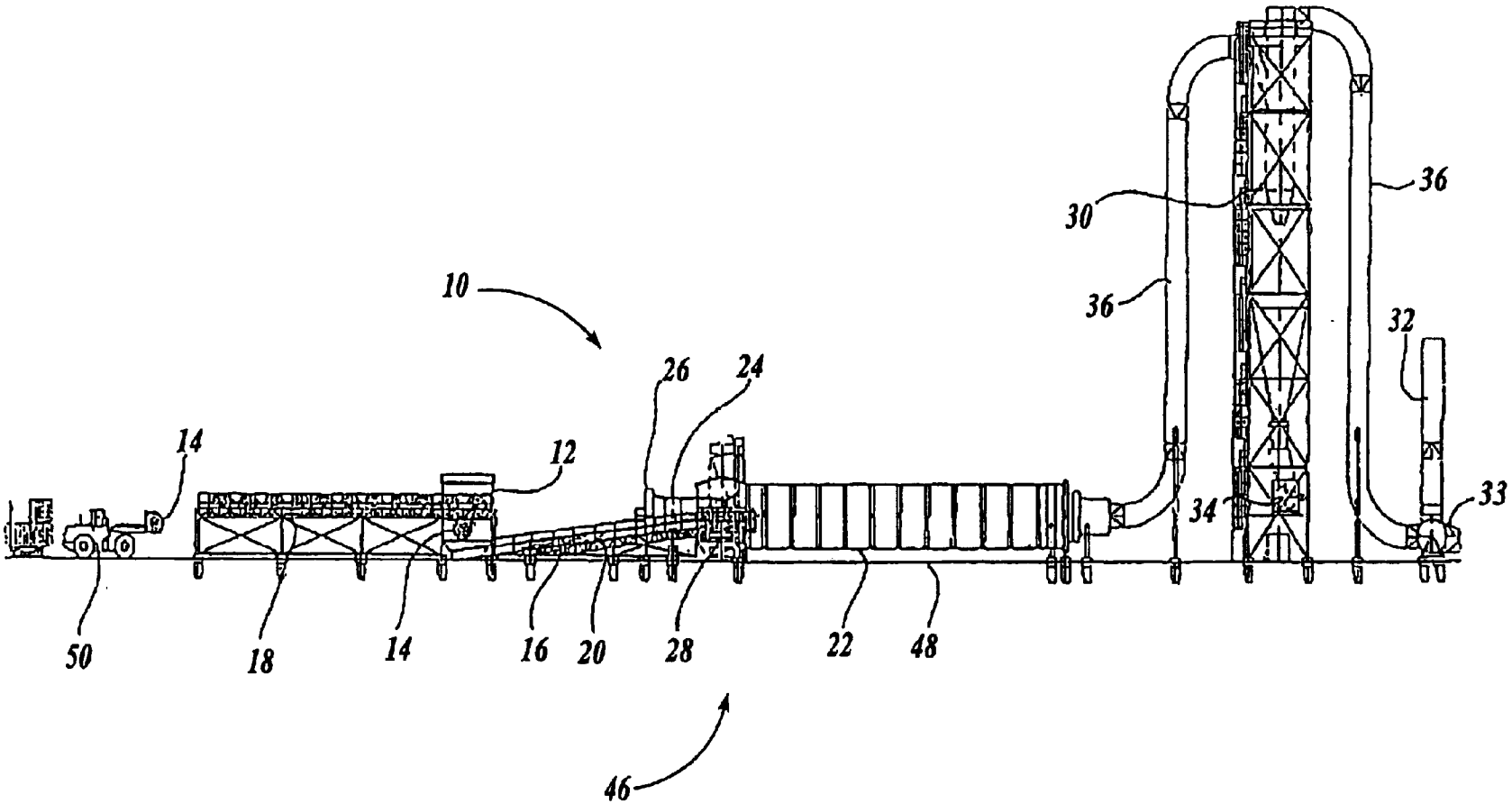
FIG. 1 is a side elevation view of an apparatus constructed in accordance with the teachings of the preferred method.

The preferred embodiment, an apparatus for drying long fibre hay generally identified by reference numeral 10, will now be described with reference to FIGS. 1 and 2.

Structure and Relationship of Parts:

Referring to FIG. 1, apparatus 10 includes a hay bale separator 12 that is adapted to separate a round bale 14 into a loose mass of long fibre hay 16. A first conveyor 18 is provided for conveying round bales 14 to separator 12. A second conveyor 20 is provided which conveys loose mass long fibre hay 16 from separator 12 to a rotary dehydration drum 22. Referring to FIG. 2, a feed drum 24 that has a heat shield 26 is provided for feeding loose mass long fibre hay 16 into dehydration drum 22. A metering box 28 is provided for controlling the flow of loose mass of long fibre hay 16 into dehydration drum 22, however other means can also be used to control the flow.

Referring to FIG. 1, a cyclone separator 30, an exhaust 32 having an exhaust fan 33 and an air lock 34 are also provided. Cyclone separator 30 is adapted to remove air containing entrained moisture from loose mass of long fibre hay 16. Ducting 36 is provided for conveying loose mass of long fibre hay 16 containing air to cyclone separator 30 and for delivering a first stream of only air to exhaust 32 and a second stream of only loose mass of long fibre hay 16 to air lock 34. Referring to FIG. 2, a third conveyor 38 that is exposed to a flow of cooling air from spaced apart fans 40 is provided for cooling loose mass of long fibre hay 16. It will be appreciated that other means are available for cooling loose mass of long fibre hay 16. A baler 42 is provided that is adapted to form loose mass of long fibre hay 16 back into bales 44.

Operation:

The method of use and operation of an apparatus for drying long fibre hay will now be described with reference to FIGS. 1 and 2. Referring to FIG. 1, round bales 14 of long fibre hay are provided at a site 46 where apparatus 10, as described above, has been installed on a cement pad 48. A loading vehicle such as a tractor 50 with a front end loader is used to moved round bales 14 onto first conveyor 18 of apparatus 10. First conveyor 18 then moves round bales 14 to separator 12. In separator 12, round bales 14 are separated to form loose mass of long fibre hay 16. Second conveyor 20 then moves loose mass of long fibre hay 16 to feed drum 24 which feeds loose mass of long fibre hay 16 into dehydration drum 22. Metering box 28 controls the flow of loose mass of long fibre hay 16 into dehydration drum 22.

Figure 2:
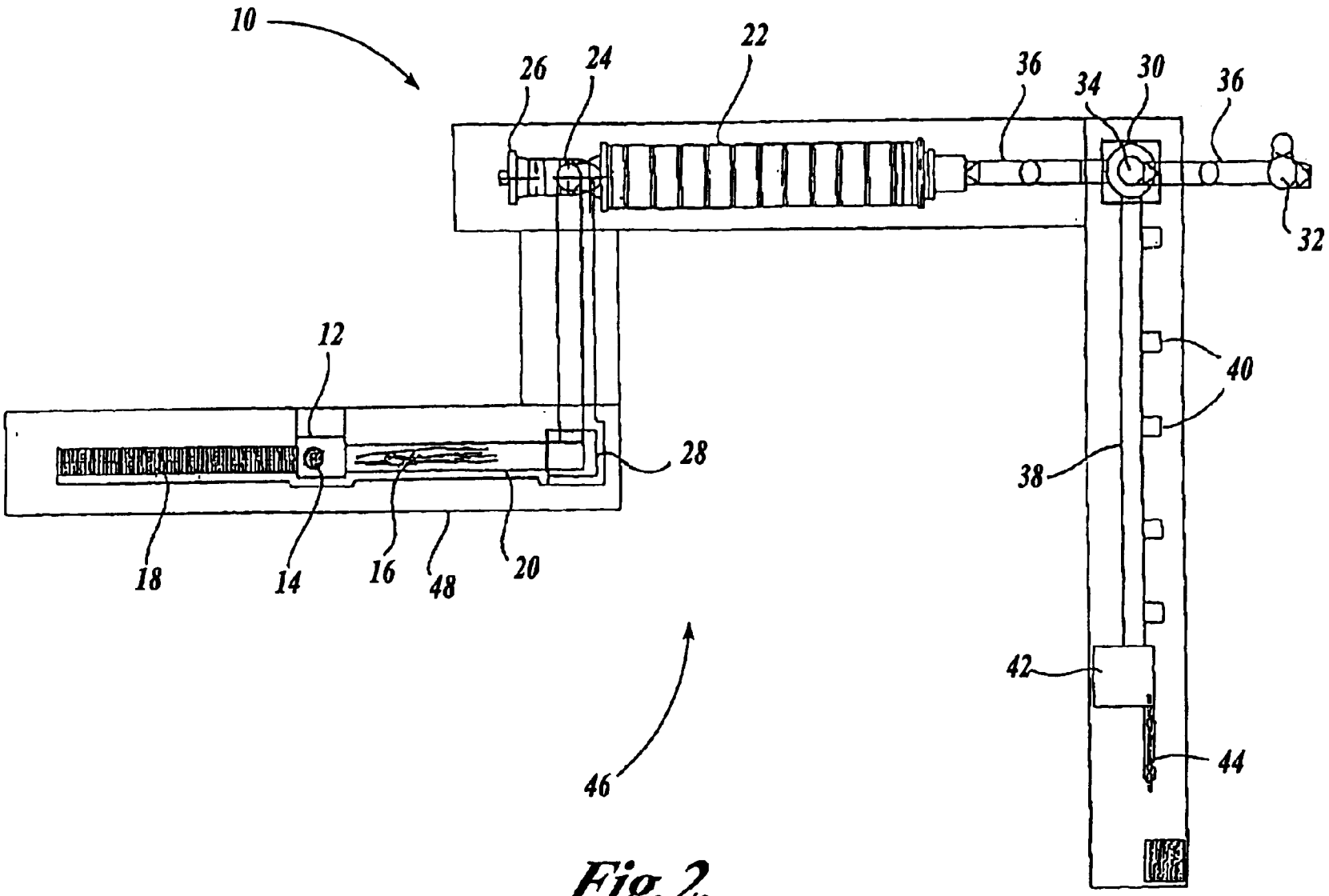
FIG. 2 is top plan view of the apparatus illustrated in FIG. 1.

Referring to FIGS. 1 and 2, loose mass of long fibre hay 16 is then separated from the air containing entrained moisture by passing long fibre hay 16 through cyclone separator 30 with a first stream of air passing to exhaust 32 and a second stream of loose mass of long fibre hay 16 passing into air lock 34. Air is drawn through ducting 36 by exhaust fan 33 which draws all air to exhaust 32. The loose mass of long fibre hay 16 is carried along by the stream of air until it is diverted via cyclone separator 30 into air lock 34.

Referring to FIG. 2, loose mass of long fibre hay 16 is then cooled by passing loose mass of long fibre hay 16 along third conveyor 38 where loose mass of fibre hay 16 is exposed to a flow of cooling air provided by fans 40 which are spaced apart along third conveyor 38. After being conveyed along third conveyor 38, loose mass of long fibre hay 16 is passed through hay baler 42. By passing loose mass of long fibre hay through hay baler 42, loose mass of long fibre hay 16 is then formed back into bales 44 in preparation for transportation.

All of the components described above are commercially available. They have, however, been combined to create a unique processing system in accordance with the teachings of the method. Hay bale separators, such as separator 12, are sold in Canada and the United States under Trade Marks "HAYBUSTER" and "DEWEZE". Hay balers, such as hay baler 42, are sold in Canada and the United States under Trade Marks "NEW HOLLAND", "FREEMAN" and "HESTON". Rotary dehydration drum dryer technology is well known. There are a number of manufacturers in Canada and the United States that will manufacture rotary dehydration drum dryers, such as rotary dehydration drum 22, to meet customer's needs. One having sufficient capacity to meet the processing requirements of the present application was manufactured by "DACRO" using a "MAXON" burner to supply heat. There are a number of manufacturers in Canada and the United States that will manufacture cyclone separators, such as cyclone separator 30, to meet customer's needs. One having sufficient capacity to meet the processing requirements of the present application was manufactured by "ALLIED BLOWERS".

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for drying long fibre hay, comprising the steps of:

firstly, providing bales of long fibre hay;

secondly, separating the bales to form a loose mass of long fibre hay;

thirdly, feeding the loose mass of long fibre hay into a rotary dehydration drum;

fourthly, separating the loose mass of long fibre hay from air containing entrained moisture by passing the long fibre hay through a cyclone separator with a first stream of air passing to an exhaust and a second stream of the loose mass of long fibre hay passing into an air lock;

fifthly, cooling the loose mass of long fibre hay; and sixthly, passing the loose mass of long fibre hay through a hay baler, whereby the loose mass of long fibre hay is formed back into bales.

2. An integrated system for drying long fibre hay, comprising in combination:

a hay bale separator adapted to separate bales into a loose mass of long fibre hay;

a conveyor associated with the hay bale separator for conveying the loose mass long fibre hay from the hay bale separator to a rotary dehydration drum;

a cyclone separator adapted to remove air containing entrained moisture from the loose mass of long fibre hay;

an exhaust;

an air lock;

ducting for conveying the loose mass of long fibre hay containing air from the rotary dehydration drum to the cyclone separator and delivering a first stream of primarily air to the exhaust and a second stream of primarily the loose mass of long fibre hay to the air lock;

apparatus adapted to cool the loose mass of long fibre hay received from the air lock; and a baler adapted to form the loose mass of long fibre hay back into bales.

3. An integrated system for drying long fibre hay, comprising in combination:

a hay bale separator adapted to separate bales into a loose mass of long fibre hay;

a first conveyor for conveying bales to the hay bale separator;

a rotary dehydration drum;

a second conveyor for conveying the loose mass long fibre hay from the hay bale separator to the rotary dehydration drum;

a cyclone separator adapted to remove air containing entrained moisture from the loose mass of long fibre hay;

an exhaust;

an air lock;

ducting for conveying the loose mass of long fibre hay containing air from the rotary dehydration drum to the cyclone separator and delivering a first stream of only air to the exhaust and a second stream of only the loose mass of long fibre hay to the air lock;

apparatus adapted to cool the loose mass of long fibre hay received from the an lock; and a baler adapted to form the loose mass of long fibre hay back into bales.

4. The integrated system as defined in claim 3, further controlling apparatus adapted to control the flow of the loose mass of long fibre hay into the dehydration drum.

5. The apparatus integrated system as defined in claim 4, wherein the apparatus adapted to control the flow of the loose mass of long fibre hay is a metering box.

6. The integrated system as defined in claim 3, wherein the apparatus adapted to cool the loose mass of long fibre bay is a conveyor exposed to a flow of cooling air.

* * * * *

UNITED STATES PATENT AND TRADEMARK OFFICE

CERTIFICATE OF CORRECTION

PATENT NO. : 6,754,977 B2
DATED : June 29, 2004
INVENTOR(S) : R.J.A. Roberts

It is certified that error appears in the above-identified patent and that said Letters Patent is hereby corrected as shown below:

Column 4,
Line 41, “the an lock;” should read -- the air lock; --
Line 46, “controlling” should read -- comprising --
Line 53, “bay” should read -- hay --

Signed and Sealed this

Twenty-sixth Day of October, 2004

JON W. DUDAS
*Director of the United States Patent and Trademark Office*